US006383336B1

(12) United States Patent
Shannon

(10) Patent No.: US 6,383,336 B1
(45) Date of Patent: May 7, 2002

(54) STRONG, SOFT NON-COMPRESSIVELY DRIED TISSUE PRODUCTS CONTAINING PARTICULATE FILLERS

(75) Inventor: Thomas G. Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/461,089

(22) Filed: Dec. 14, 1999

(51) Int. Cl.[7] ..... D21H 21/22

(52) U.S. Cl. ..... 162/158; 162/109; 162/111; 162/112; 162/179; 162/181.1; 162/148

(58) Field of Search ..... 162/111, 112, 162/113, 158, 179, 181.1, 183, 148

(56) References Cited

U.S. PATENT DOCUMENTS 4,425,188 A * 1/1984 May et al. ..... 162/179
4,940,513 A * 7/1990 Spendel ..... 162/179
5,048,589 A 9/1991 Cook et al.
5,296,024 A 3/1994 Hutcheson
5,336,373 A 8/1994 Scattolino et al.
5,417,753 A 5/1995 Hutcheson
5,488,139 A 1/1996 Dragner et al.
5,498,315 A 3/1996 Dragner et al.
5,558,873 A * 9/1996 Funk et al. ..... 428/401
5,607,551 A 3/1997 Farrington, Jr. et al.
5,611,890 A * 3/1997 Vinson et al. ..... 162/181.1
5,695,607 A * 12/1997 Oriaran et al. ..... 162/179
5,700,352 A 12/1997 Vinson et al.
5,759,346 A 6/1998 Vinson
5,779,860 A 7/1998 Hollenberg et al.
5,830,317 A 11/1998 Vinson et al.
6,077,393 A 6/2000 Shannon et al.

* cited by examiner

*Primary Examiner*—Peter Chin
(74) *Attorney, Agent, or Firm*—Nelson Mullins Riley & Scarborough

(57) ABSTRACT

A relatively soft, strong, opaque paper product and a process for making the same are provided. In particular, a tissue, or other paper product, is formed by incorporating into the product an alkylamide or alkylimide softening agent along with particulate fillers during a non-compressive tissue-formation process.

21 Claims, No Drawings

STRONG, SOFT NON-COMPRESSIVELY DRIED TISSUE PRODUCTS CONTAINING PARTICULATE FILLERS

FIELD OF THE INVENTION

The present invention generally relates to particulate filler-containing tissue products such as bath tissue, facial tissue and towels, and methods of making the same. In addition to the particulate filters which are generally employed to improve the opacity of the paper-containing products, the present invention employs certain additives and, more specifically, incorporates alkyl amides into such tissue products. The additives reduce the negative impact on the tissue's softness and strength often caused by the presence of the particulate fillers.

BACKGROUND OF THE INVENTION

The most common approach for improving the opacity of paper products involves the incorporation of various particulate fillers, such as pigments, into the products. Pigments generally include inorganic particulate fillers such as kaolin clay, calcium carbonate or titanium dioxide. Other fillers known in the art include talc, zirconium dioxide, zinc oxide, calcium silicate, aluminum silicate, calcium sulfate, alumina trihydrate, and mixtures of such materials. They can be applied either in the wet end of a tissue-making process or as a coating, or other dry-end additive, to an already-formed tissue web. Much research has been devoted to the use of such particulate fillers for the purpose of increasing the opacity and brightness primarily in newsprint, bible and directory papers and fine papers.

Usually, these particulate fillers are applied in the wet end of the papermaking process by flocculating the filler with a cationic starch and using a cationic retention aid at the outlet of the fan pump. Flocculant size is often an important aspect of maintaining desirable opacity levels and strength in tissue products. If the flocculent particles are too large, good retention is achieved but with a significant loss of strength and poor opacity due to the reduction of air-filler and fiber-filler interfaces. On the other hand, if the flocculent particles are too small, retention is poor even though less strength is lost and greater opacifying efficiency is obtained. Complete books such as R. W. Hagemeyer, ed., *Pigments for Paper*, TAPPI Press, 1997 have been written regarding use of pigments in the paper industry where their primary use is to increase opacity and brightness in products of reduced basis weight. These references describe both the products and processes by which the fillers are incorporated. Kaolin clay is one of the most widely used particulate fillers used to improve the opacity of various paper products, including tissues. Kaolin is particularly attractive due to its very low cost, which is currently about $0.07/lb. The opacifying power of kaolin clay is considerably poorer than that of titanium dioxide, but the much higher cost of titanium dioxide (currently about 10–20 times the cost of Kaolin) often offsets any drawback in opacity efficiency.

Kaolin is comprised of aluminum silicate and is commercially available in two primary forms called hydrous and calcined. Natural kaolin, referred to as "hydrous" kaolin, has the chemical structure $Al_2(OH)_4Si_2O_5$. Subjecting natural kaolin to temperatures in excess of 450 C. results in a loss of water and the rearrangement of its basic crystalline structure. Such kaolin is referred to as "calcined" kaolin and has the chemical structure $Al_2O_3SiO_2$. Calcined kaolin is advantageous over hydrous kaolin in that it results in higher brightness. However, a disadvantage of calcined kaolin is that it is more abrasive than hydrous kaolin.

Kaolin has a structure which allows the crystal lattice to form thin platelets that adhere together to form "stacks" or "books". During processing, some separation into individual platelets does occur. Each clay platelet is a multilayer structure of aluminum polysilicate. Each basic layer contains a face consisting of a continuous array of oxygen atoms uniting the edges of the polysilicate sheet structure. The other face consists of octahedral alumina structures joined by hydroxyl groups, which, in essence, forms a two-dimensional polyaluminum oxide structure. The aluminum and silicon atoms are bound by oxygen atoms sharing the tetrahedral and octahedral structures. Imperfections in the assembly are primarily responsible for the anionic charge that the natural clay particles possess while in suspension. Other divalent, trivalent, and tetravalent cations substitute for aluminum with the consequence that some of the oxygen atoms on the surface become anionic and form weakly dissociated hydroxyl groups.

Kaolins also possess a cationic character. If this cationic character is not satisfied with solution anions, the clay will satisfy its own charge balance in that the crystal structure orients itself edge-to-face and forms thick dispersions. To remedy this, polyacrylate dispersants capable of ion exchange with the cationic sites are often added to the kaolin. Kaolin clay is usually purchased as a solid powder incorporated with a polyacrylate dispersant.

Titanium dioxide, although it is more expensive than kaolin, exhibits a greater opacifying power than kaolin. The greater opacifying power of Titanium oxide relative to Kaolin means that lower levels of filler are required to produce a given opacity. This, in turn, may provide a greater capability of making a filled product at a given opacity with a higher degree of softness because less filler is used.

Among the types of titanium dioxide available are Anatase and Rutile. Anatase titanium dioxide has more opacifying power than Rutile, but it is also more abrasive and expensive.

As mentioned above, cationic starches are commonly used to agglomerate the kaolin clay or other filler particles. It is believed that the cationic starch becomes insoluble after binding to the anionically-charged filler particles. The goal of agglomeration is having the filler covered with the bushy starch molecules. The starch molecules provide a cationic surface for the attachment of more filler particles, causing an increase in agglomerate size.

The size of the starch filler agglomerates is an important factor in obtaining the optimal balance of strength and optical properties. Agglomerate size is controlled by the rate of shear supplied during the mixing of the starch with the filler. The agglomerates, once formed, are not overly shear sensitive, but they can be broken down over an extended period of time or in presence of very high shear forces.

The charge characteristic of the starch is significant as well. Since starch is usually employed at an amount of less than 5% by weight of filler, the filler-starch agglomerates possess a negative charge. In this case, a cationic retention aid is utilized.

Higher levels of starch are sometimes employed. In these instances, the filler-starch agglomerates may actually possess a net positive charge and would, thus, require the use of an anionic retention aid.

Various anionic and cationic retention aids are known in the art. Generally, the most common anionic retention aids are charged polyacrylates, whereas the most common cationic retention aids are charged polyacrylamides. These retention aids agglomerate the suspended particles through the use of a bridging mechanism. A wide range of molecular weights and charge densities are available. In general, high molecular weight materials with a medium charge density are preferred for flocculating particulate fillers. The filler retention aid flocs are easily broken down by shear forces and are usually added after the fan pump.

Nonparticulate fillers may also be employed. One such class of nonparticulate fillers includes thermoplastic microspheres. Such non-particulate fillers are generally applied as a coating in a post-treatment operation; however, they may be applied in the wet end. When applied in the wet end, these non-particulate fillers may have the same deleterious impact on strength and softness as do particulate fillers.

While particulate, as well as non-particulate fillers, may be incorporated into tissue products in order to render the products more opaque, several drawbacks exist as a result of the incorporation of these fillers into tissue products. One such drawback of using fillers involves the weak bond between filler particles and the fiber. Even when retention aids are utilized, the bond is weak and is subject to breaking in the presence of relatively low shear forces. Hence, retention is generally low. Additional considerations include fouling of the wet end system, plugging of felts, and the wear on the equipment caused by the abrasive nature of the filler pigments.

Also, the addition of particulate fillers to tissue products results in decreased softness and strength of the tissue products. Specifically, the presence of filler particles on fiber surfaces inhibits fiber-to-fiber bonding during sheet consolidation. This decreased fiber-to-fiber bonding leads to a weakening of sheet strength.

In the manufacture of tissue products such as facial tissue, bath tissue, paper towels, dinner napkins, and the like, it is well known that strength and softness are generally inversely related. Thus, since the addition of particulate fillers into tissue products typically reduces both strength and softness, it becomes extremely difficult to form a final product wherein both strength and softness have been improved.

Attempts have been made at solving this problem. For example, decreased strength may be curtailed by reducing the level of debonders used in the tissue products and by increasing the level of refining or strength agents. Such increased use of chemical strengthening agents, however, results in higher costs and in further softness degradation. More specifically, the softness parameters of stiffness and grittiness are negatively affected by the inclusion of particulate fillers into tissue products.

On the other hand, while the addition of debonders to a tissue making furnish is a common example of a chemical means for softening the sheet, the resulting sheet is significantly weaker than sheets not employing debonders. Mechanical debonding processes such as creping may also be used for increased softness, but the tissue product may experience the same loss of strength as a product that has been chemically debonded.

Prior art does exist that discusses the limitations with regard to impact on softness relative to the incorporation of particulate fillers into tissue products. Specifically, U.S. Pat. No. 5,830,317 to Vinson et al. mentions the negative impact of fillers on the softness of tissue products. This reference explain that many corrective actions taken to overcome the retention and strength limitations of filled tissue products actually cause a reduction in softness. Vinson et al. is directed to a method for overcoming these limitations through the use of biased surface properties incorporating a bond inhibiting agent within the fabric-side surface of the tissue product. Not only is the technology complex, but the patent is limited to the production of a layered sheet.

Thus, a need exists for a less complex process for incorporating particulate fillers into tissue products, which does not require the production of a layered sheet and which results in a stronger, softer tissue product.

The state-of-the-art reveals that the addition of particulate fillers to tissue products consistently results in a negative impact on the softness and strength of the tissue products. Therefore, a need currently exists for a process in which a compound is incorporated into non-compressively dewatered tissue products containing particulate fillers so that the tissue products retain a sufficient amount of both softness and strength.

SUMMARY OF THE INVENTION

Some of the above-mentioned drawbacks are overcome and needs met by incorporating an alkylamide or alkylimide softening agent into a tissue product containing particulate fillers. In particular, the process incorporates the additives into a process that forms the paper products through an uncompressed through-air drying process. The softening agent undergoes significantly less debonding during the course of such an uncompressed through-air drying process than in other processes, resulting in improved strength and softness.

The alkylamides or alkylimides used in the process of the present invention comprise a mono or disubstituted amide derived from a primary or secondary amine and an alkyl fatty acid group. The alkylamides or alkylamide may contain unreacted secondary amine groups and hydroxyl groups and may bear a slight cationic charge when delivered in a low pH solution. The softening agents may be added to particulate filler-containing tissue products at a rate of between about 0.5 and about 30 pounds per metric ton of fiber.

These and other features, aspects and advantages of the present invention will become better understood with reference to the following description and appended claims.

DETAILED DESCRIPTION OF REPRESENTATIVE EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

Generally, the present invention employs certain alkyl amides, and specifically hydroxyalkyl amides (such as those sold under the tradename of REACTOPAQUE and manufactured by Sequa Chemical Company in Chester, S.C.), in non-compressive dewatering processes for making tissues products where particulate fillers are also used. The use of the presently described alkyl amides reduce the negative impact on the softness of the tissue products caused by incorporation of the fillers. The alkyl amide emulsions allow for increased opacity in tissue products while the tissue products are able to maintain higher levels of strength and softness. Alkyl amides sold under the trademark REACTOPAQUE are described in U.S. Pat. Nos. 5,296,024 and 5,417,753 to Hutcheson, both of which are incorporated herein in their entireties by reference thereto.

In certain embodiments of the present invention, a tissue sheet may comprise particulate filler and one or more alkylamide and/or alkylimide softening agents having at least one of the following structures:

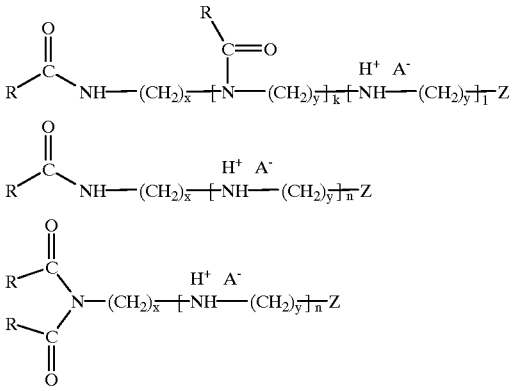

wherein:

R=any saturated or unsaturated fatty acid group having a chain length of 6 to 22 carbon atoms;

n=0–6;

x=1 to 6;

y=1 to 6;

k, l≧0, k+l=n

Z=H, OH; and

A=any anion of a strong or weak acid.

In another aspect, the invention is a method of making a soft and strong tissue sheet by:

(a) adding one or more alkylamide or alkylimide softening agents to an aqueous suspension of papermaking fibers containing a particulate filler and maintaining the resulting aqueous mixture of fibers and softening agents at a temperature of from about 20° C. to about 70° C. for at least 10 minutes, wherein the softening agent(s) is represented by one or more of the following structures:

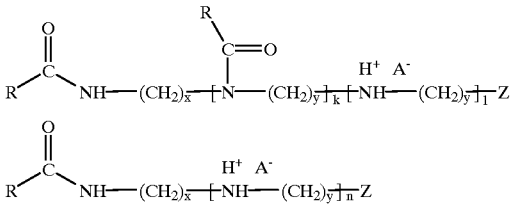

-continued

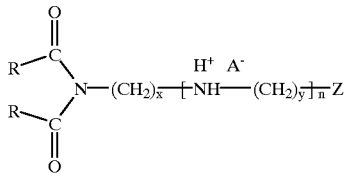

wherein:

R=any saturated or unsaturated fatty acid group having a chain length of 6 to 22 carbon atoms;

n=0 to 6;

x=1 to 6;

y=1 to 6;

k, l≧0, k +l=n

Z=H, OH; and

A=any anion of a strong or weak acid;

(b) depositing the aqueous suspension of papermaking fibers onto a forming fabric to form a tissue web; and (c) non-compressively dewatering and drying the web to form a soft tissue sheet.

Suitable commercially available alkylamides are sold as aqueous solutions under the trade name REACTOPAQUE® 100, 102 and 115 by Sequa Chemical Company of Chester, S.C. These three commercial materials are believed to be blends of the alkylamides set forth in structural formulas (1) and (2) above and disclosed in the Hutcheson patents referred to above. REACTOPAQUE 102 is about 20 weight percent solids, REACTOPAQUE 100 is about 10 weight percent solids, and REACTOPAQUE 115 is about 15 weight percent solids.

The amount of the alkylamide or alkylimide softening agent, on a solids basis, used to obtain the improved softness can be from about 0.25 to about 30 pounds per metric ton of fiber, more specifically from about 1 to about 20 pounds per metric ton of fiber, and even more specifically from about 2 to about 15 pounds per metric ton of fiber. In mixing the alkylamide and/or the alkylimide with the aqueous suspension of papermaking fibers, it is desirable to maintain the mixture in a heated condition for a period of time before forming the tissue web. The temperature of the aqueous fiber suspension/softening agent mixture can be from about 20° C. to about 90° C., more specifically from about 30° C. to about 80° C., and still more specifically from about 40° C. to about 70° C. The length of time that the mixture is maintained at the elevated temperature can be about 5 minutes or longer, more specifically from about 5 minutes to about 40 minutes, and still more specifically from about 5 minutes to about 20 minutes.

The alkylamides and/or alkylimide softening agents can be mixed with the entire furnish used to make the tissue or they can be added to selected portions of the furnish, such as the furnish of one or more layers of a layered tissue. Alternatively, the amounts of the softening agents can be the same or different in each of the furnish layers.

The disclosed alkylamides and alkylimides are utilized in a process that forms a paper product without compressing the laid web. In other words, the present process utilized an uncompressed process such as uncompressed through-air drying. Such softening agents debond significantly less during the course of these types of uncompressive drying processes than in other processes, resulting in improved strength. However, softness is maintained at the same time.

Such processes for forming uncreped or uncompressed through-air dried webs are described in U.S. Pat. Nos.

5,779,860 to Hollenberg et al. and 5,048,589 to Cook et al., both of which are assigned to the assignee of the present invention and both of which are incorporated herein in their entireties by reference thereto. In such processes, through air drying is employed as shown in the Figures of Cook et al. As described and shown therein, a web is prepared by: (1) forming a furnish of cellulosic fibers, water, and a chemical debonder; (2) depositing the furnish on a traveling foraminous belt, thereby forming a fibrous web on top of the traveling foraminous belt; (3) subjecting the fibrous web to noncompressive drying to remove the water from the fibrous web; and (4) removing the dried fibrous web from the traveling foraminous belt. The process described therein does not include creping and is, thus, referred to as an uncreped through-air drying process. (Creped process are applicable as well to the presently described inventive process.)

Tissue products prepared from such through-air drying processes will typically possess relatively high levels of absorbent capacity, absorbent rate, and strength. In addition, because the process avoids the use of costly creping steps (in the uncreped versions), tissue products formed according to such a process will generally be more economical to produce than creped tissue products of similar composition and basis weight.

A process that produces a noncompressed sheet using can drying which may be employed in the present invention is described in U.S. Pat. No. 5,336,373 to Scattolino et al., which is also incorporated herein in its entirety by reference thereto. Like the above-described through-air drying process, such can drying processes do not compressively dewater and dry the laid paper web.

The absence of a wet press step allows for the described softening agents to be used at addition levels high enough to provide a positive impact on softness. Addition levels of as little as 3 pounds per ton of tissue may provide a significant enhancement to the overall product softness. In addition, the lack of grittiness, which is one aspect of softness, may be significantly improved by the incorporation of the described agents.

Papermaking fibers for making the paper, or tissue product, webs of this invention include any natural or synthetic fibers suitable for the end use products listed above including, but not limited to: nonwoody fibers, such as abaca, sabai grass, milkweed floss fibers, pineapple leaf fibers; softwood fibers, such as northern and southern softwood kraft fibers; hardwood fibers, such as eucalyptus, maple, birch, aspen, or the like. In addition, furnishes including recycled fibers may also be utilized. In making the tissue products, the fibers are formed into a pulp furnish by known pulp stock formation processes.

In the process of the present invention, the agents may be added to the thick stock (for example directly to the pulper) at an elevated temperature. Additional chemicals including debonders (which are often also called softening agents) may be employed as well. Suitable debonders include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betane, sodium lauryl sarcosinate, partly ethoxylated quatemary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di(hydrogenated tallow) dimethyl ammonium chloride) manufactured by Akzo Chemical Company. Suitable amounts of softening agents will vary greatly with the species of pulp selected and the desired characteristics of the resulting tissue product. Such amounts can be, without limitation, from about 0.05 to about 1 weight percent based on the weight of fiber, more specifically from about 0.1 to about 0.75 weight percent, and still more specifically about 0.25 weight percent.

In addition various temporary wet strength resins, wet strength resins, dry strength resins, and the like, may also be incorporated without adversely impacting the performance of the alkyl amides and alkyl imides.

A cationic starch may generally be employed in order to flocculate the filler at an amount. When employed, the cationic starch may be added up to about 0.5% weight of the filler. A cationic retention aid may also be added to improve retention. When employed, the retention aid is usually added after the fan pump at a level of 0.1–1.5 pounds per metric ton. The process used to incorporate these fillers is typical of the process used for incorporation of fillers into fine papers.

While the present invention is exemplified by the use of a wet-end process, the various softening agents may also be applied at the dry-end of the process. In such embodiments, the described additives may be provided to the tissue products by conventional post-formation applying means such as printing, brushing, spraying, dipping, doctor blading, foamed emulsion, gravure roll polymer emulsion, padding, nip-pressure binder pick-up, direct or offset gravure printing and the like. The use of a binder in conjunction with the various filler-type pigments may also be necessary in such post-formation applications, particularly the various printing and brushing techniques, but not necessarily in techniques such as spraying. It should be understood that the present invention is not limited to any particular application process for applying the softening agents and fillers to a formed treatment product.

Papers employing various particulate fillers will benefit from incorporation of the claimed softening agents. As is known, fillers may be incorporated into the furnish in amounts of up to 30% by weight of the fibers.

EXAMPLES

The present invention may be understood by reference to the following Examples, without being limited thereto.

In Examples 1–5 below, one-ply, non-layered uncreped through dried tissue basesheets were made generally in accordance with the process described in U.S. Pat. No. 5,607,551 issued Mar. 4, 1997, to Farrington et al. entitled "Soft Tissue", which is herein incorporated by reference in its entirety.

Several tests were performed on the tissue products, and data was collected about each of the five Examples. The data is shown in Tables I and II below. The tests results were gathered using well-known testing procedures.

The basis weight and bone dry basis weight of the specimens was determined using a modified TAPPI T402 procedure. As is basis weight samples were conditioned at 23° C.±1° C. and 50±2% relative humidity for a minimum of 4 hours. After conditioning a stack of 16—3"×3" samples was cut using a die press and associated die. This represents a sample area of 144 $in^2$. Examples of suitable die presses are TMI DGD die press manufactured by Testing Machines, Inc. or a Swing Beam testing machine manufactured by USM Corporation. Die size tolerances are +/−0.008 inches in both directions. The specimen stack is then weighed to the nearest 0.001 gram on a tared analytical balance. The basis weight in pounds per 2880 $ft^2$ is then calculated using the following equation:

$$\text{Basis weight}=\text{stack wt. in grams}/454^* 2880$$

The bone dry basis weight is obtained by weighing a sample can and lid the nearest 0.001 grams (this weight is A). The sample stack is placed into the can and left uncovered. The uncovered sample can and stack along with can lid is placed in a 105° C.±2° C. oven for a period of 1 hour±5 minutes for sample stacks weighing less than 10 grams and at least 8 hours for sample stacks weighing 10 grams or greater. After the specified oven time the sample can lid is placed on the can and the can removed from the oven. The cans are allowed to cool to approximately ambient temperature but no more than 10 minutes. The can, cover and specimen are then weighed to the nearest 0.001 gram (this weight is C). The bone dry basis weight in lbs./2880 $ft^2$ is calculated using the following equation:

$$\text{Bone Dry } BW=(C-A)/454^*2880$$

The actual fiber basis weight of the sample is calculated from the % ash and the bone dry basis weight according to the following equation:

$$\text{Fiber basis weight}=\text{bone dry basis wt.}^*(1-\%\text{ash}/100)$$

The Geometric Mean Tensile (GMT) strength test results are expressed as grams-force per 3 inches of sample width. GMT is computed from the peak load values of the MD (machine direction) and CD (cross-machine direction) tensile curves, which are obtained under laboratory conditions of 23.0+/−1.0° Celsius, 50.0+/−2.0 percent relative humidity, and after the sheet has equilibrated to the testing conditions for a period of not less than four hours. Testing is done on a tensile testing machine maintaining a constant rate of elongation, and the width of each specimen tested was 3 inches. The "jaw span" or the distance between the jaws, sometimes referred to as gauge length, is 2.0 inches (50.8 mm). Crosshead speed is 10 inches per minute (254 mm/min.) A load cell or full scale load is chosen so that all peak load results fall between 10 and 90 percent of the full scale load. In particular, the results described herein were produced on an Instron 1122 tensile frame connected to a Sintech data acquisition and control system utilizing IMAP software running on a "486 Class" personal computer. This data system records at least 20 load and elongation points per second. The geometric mean tensile is calculated from the following equation:

$$GMT=(MD\ \text{Tensile}^*CD\ \text{Tensile})^{1/2}$$

The caliper of the formed webs represents the thickness of a single sheet, expressed in microns. Caliper is measured under laboratory conditions of 23.0+/−1.0° Celsius, 50.0+/−2.0 percent relative humidity, and only after the sheet has equilibrated to the testing conditions for a period of not less than four hours. The micrometer used for carrying out this measurement is an Emveco model 200-A with flat ground, circular pressure foot and anvil and with factory modifications to meet the following specifications:

A round pressure foot diameter of 56.42 millimeters (equating to an area of 2500 square millimeters);

Pressure foot loading of 2.00 kiloPascals;

0 to 7.6 mm test capacity;

Readout resolution of 0.001 millimeters;

Repeatability of 0.001 millimeters;

Linearity of +/−0.25 percent;

Dwell time of 3.0+/−1.0 seconds;

Lowering rate of 0.8 millimeters +/−0.1 per second; and

Pressure foot and anvil to be parallel within 0.001 mm.

The products of this and the following examples were also tested for Dry Burst Energy ratings. Specifically, "Mullen Burst" measures the toughness of a material by inflating the material with a diaphragm until it ruptures. These tests may be undertaken utilizing conventional testing equipment and techniques. These tests were conducted utilizing a Mullen Burst Strength Tester, such as those manufactured by B. F. Perkins & Son Inc., whose address is GPO 366, Chicopee, Mass. 01021 or Testing Machine Inc., whose address is 400 Bayview Avenue, Amityville, N.Y. 11701. The test procedure included clamping a sample having a length and width of about 12.7 centimeters above a rubber diaphragm, inflating the diaphragm by pressure generated by forcing liquid into a chamber at about 95 milliliters per minute, and recording the pressure at which the sample ruptures. The rupture pressure was reported in pascals. Dry burst is expressed in pounds per square inch.

Furthermore, tests for panel grittiness (top and bottom), panel fuzziness (top and bottom) and panel stiffness were performed by panelists who rubbed the formed tissue products and compared the grittiness and stiffness of the products to high and low standard values. After comparing these characteristics to the standards, the panelists assigned a relative value for the tissue products' grittiness and panel stiffness. Then, for the purpose of the present Examples, the numbers 1–5 were assigned to the products to denote which experimental tissue sheets are grittier, less fuzzy and stiffer. In Table I, the number 1 has been assigned to the Example tissue product that is grittiest, least fuzzy and stiffest, while the number 5 has been assigned to the tissue product that was least gritty, most fuzzy and least stiff. Thus, the most desired tissue product has a rating of 5 for grittiness top and bottom, fuzziness top and bottom, and for panel stiffness.

The Panel Softness is a calculated value using a standard procedure wherein the rating measures overall softness of the tissue product. The panel softness proxy rating takes into account several parameters of the tissue product including stiffness, fuzzy up, fuzzy down, gritty up, and gritty down. The numerical system for Panel Softness Proxy in Table I is the same as the rating system described above for panel grittiness and panel stiffness. The number 1 has been assigned to the Example tissue that has the lowest panel softness proxy rating, while the number 5 has been assigned to the Example tissue with the highest panel softness proxy rating. Thus, the most desired tissue product has a rating of 5 for panel softness proxy.

The CD (or cross-machine direction) Slope is the two parameter, least squares line regression coefficient (sometimes referred to as slope) obtained from the tensile load/elongation curve for all points falling between a load of 70 grams and 157 grams during the ascending part of the curve. The regression coefficient is multiplied by the jaw span and divided by the specimen width to normalize the result, resulting in the final CD Slope value. The CD Slope values may be obtained from the CD tensile curves utilized for the GMT calculation. CD Slope utilizes an identical 3 inch specimen width and two inch jaw span. The units for CD Slope are kilograms per 3 inches (7.62 centimeters), but for convenience, the CD Slope values are hereinafter referred to without units.

The CD Stiffness Factor is calculated by multiplying the CD Slope by the square root of the Caliper (measured as described above). The units of the CD Stiffness Factor are (kilograms per 3 inches) microns, but for simplicity the values of the CD Stiffness Factor are hereinafter referred to without units.

The ISO Opacity tests in these Examples were performed according to a process to measure printing opacity. The reflectance of a single test sheet of a tissue product formed according to the present invention with black backing is measured. This measurement of reflectance is $R_0$. Then, the reflectance of a single sheet with multiple sheet backing is measured, and the value of this reflectance is known as R. The final value for the printing opacity of the sheets is determined by is dividing $R_0$ by R.

Example 1

In this Example, 60 pounds (oven dry basis) of eucalyptus hardwood kraft fiber and 40 pounds (oven dry basis) of northern softwood kraft fiber were dispersed in a pulper for 30 minutes at a consistency of 3 percent. The thick stock slurry was then passed to a machine chest and diluted to a consistency of 1 percent. To the machine chest was added 182 grams (8.8 pounds per metric ton of dry fiber) of a commercially available temporary wet strength resin, Parez 631-NC. The temporary wet strength resin was added as a 6 percent aqueous solution. Eighty grams (4 pounds per metric ton of dry fiber) of a commercially available quaternary ammonium oleyl imidazoline softening agent was next added to the machine chest. The oleyl imidazoline was first diluted to a 1% solution prior to addition to the machine chest. The stock was further diluted to approximately 0.1 percent consistency prior to forming. The formed web was non-compressively dewatered and rush transferred to a transfer fabric traveling at a speed about 25 percent slower than the forming fabric. The web was then transferred to a throughdrying fabric, dried and calendered and described herein with respect to a process for forming a paper web by through-air-drying. The total basis weight of the resulting sheet was about 14 pounds per 2880 $ft^2$.

The product of this example was tested, and the results can be found in Tables I and II below.

This Example was used as the control in that no filler was incorporated into the formed web. For this control experiment, an imidazoline softener was used, and the CD stiffness factor was relatively high. Numerical values were obtained for GMT, dry burst energy, opacity and other properties and were recorded in Tables I and II. Also, comparative ratings of 4 for panel grittiness top and bottom and 5 for panel stiffness and panel softness proxy were assigned to this control Example.

Example 2

A single-ply, non-layered uncreped throughdried tissue basesheet was made essentially as described in Example 1. After pulping, the thick stock slurry was passed to a machine chest and diluted to a consistency of 1 percent. To the machine chest was added 2.5 pounds of rutile titanium dioxide filler. Twenty-four grams of a commercially available cationic starch, Redibond 5330 manufactured by National Starch, was added to the machine chest. The dry weight of starch used was equivalent to 2.0% of the weight of dry filler. The starch was added as a 5% aqueous solution to the machine chest after addition of the titanium dioxide filler was completed. After addition of the starch, 182 grams (8.8 pounds per metric ton of dry fiber) of a commercially available temporary wet strength resin, Parez 631-NC, was added to the machine chest. The temporary wet strength resin was added as a 6 percent aqueous solution. Forty-one grams (2 pounds per metric ton of dry fiber) of a commercially available quaternary ammonium oleyl imidazoline softening agent was next added to the machine chest. The oleyl imidazoline was first diluted to a 1% solution prior to addition to the machine chest. The stock was further diluted to approximately 0.1 percent consistency prior to forming. A cationic retention aid, Reten 1232 from Hercules, Inc., was diluted down to a 0.5% aqueous solution and added on the outlet side of the fan pump just prior to the headbox. The retention aid was added at a rate of 0.75 lbs. per metric ton of fiber plus filler. The formed web was non-compressively dewatered and rush transferred to a transfer fabric traveling at a speed about 25 percent slower than the forming fabric. The web was then transferred to a throughdrying fabric, dried and calendered. The total basis weight of the resulting sheet was about 14 pounds per 2880 $ft^2$. Total titanium dioxide content of the tissue as determined from ashing was 2.2%.

The particulate filler used in this example was titanium dioxide, and the softener was an imidazoline. With the addition of the particulate filler, the grittiness of the sheet greatly increased over the grittiness of the control experiment in Example 1 as evidenced by the grittiness ratings of 2 and 1 (shown in Table I below). Stiffness increased as evidenced by the rating of 2, and the panel softness proxy value decreased significantly as shown by the panel softness rating of 2. The opacity rating did not increase very significantly. There was also a decrease in dry burst energy. Thus, the addition of a particulate filler (specifically titanium dioxide) in this Example resulted in the expected decreased softness and increased stiffness.

Example 3

A single-ply, non-layered uncreped throughdried tissue basesheet was made as described in Example 1, except the fibers were initially dispersed in a pulper for 5 minutes at a consistency of 3 percent. The temperature of the water in the pulper was raised to 120° F. (49° C.) prior to addition of the pulp. Four hundred and fifteen grams of a 15 percent aqueous solution (62 grams dry basis, 3 pounds per metric ton of dry fiber) of a commercially available alkylamide (REACTOPAQUE® 115 manufactured by Sequa Chemical Company) was added to the pulper and the pulp was allowed to disperse for 25 additional minutes.

After pulping, the thick stock slurry was passed to a machine chest and diluted to a consistency of 1 percent. To the machine chest was added 2.5 pounds of rutile titanium dioxide filler. Twenty-four grams of a commercially available cationic starch, Redibond 5330 manufactured by National Starch was added next to the machine chest. The dry weight of starch used was equivalent to 2.0% of the weight of dry filler. The starch was added as a 5% aqueous solution to the machine chest and was added after addition of the filler was completed. After addition of the starch, 182 grams (8.8 pounds per metric ton of dry fiber) of a commercially available temporary wet strength resin, Parez 631-NC, was added to the machine chest. The dry strength resin was added as a 6 percent aqueous solution. A cationic retention aid, Reten 1232 from Hercules, Inc., was made down to a 0.5% aqueous solution and added on the outlet side of the fan pump just prior to the headbox. The retention aid was added at a rate of 0.75 lbs. per metric ton of fiber plus filler. The formed web was non-compressively dewatered and rush transferred to a transfer fabric traveling at a speed about 25 percent slower than the forming fabric. The web was then transferred to a throughdrying fabric, dried and calendered. The total basis weight of the resulting sheet was about 14 pounds per 2880 $ft^2$. Total titanium dioxide content of the tissue as determined from ashing was 2.3%.

The use of the alkylamide or alkylimide softener in this example rather than the imidazoline softener demonstrates a significant mitigation of the negative impact on softness and grittiness caused by the addition of the titanium dioxide filler in Example 2. Grittiness and stiffness decreased and received ratings of 3 and 4 respectively, while panel softness increased and received a rating of 3. The opacity increased as well, which is the most desired property when using particulate fillers. There was also a significant increase in dry burst energy. Thus, the advantages of incorporating the described softening agents into a tissue product containing titanium dioxide as a particulate filler are evidenced by this Example.

Example 4

A single-ply, non-layered uncreped throughdried tissue basesheet was made essentially as described in Example 1. After pulping, the thick stock slurry was then passed to a machine chest and diluted to a consistency of 1 percent. To the machine chest was added 2.5 pounds of rutile titanium dioxide and 2.5 pounds of a spray dried, predispersed kaolin, WW Fil SD manufactured by Dry Branch Kaolin. Forty-eight grams of a commercially available cationic starch, Redibond 5330 manufactured by National Starch was added next to the machine chest. The dry weight of starch used was equivalent to 2.0% of the total weight of dry filler. The starch was added as a 5% aqueous solution to the machine chest and was added after addition of the filler was completed. After addition of the starch, 182 grams (8.8 pounds per metric ton of dry fiber) of a commercially available temporary wet strength resin, Parez 631-NC, was added to the machine chest. The dry strength resin was added as a 6 percent aqueous solution. Twenty grams (1 pound per metric ton of dry fiber) of a commercially available quaternary ammonium oleyl imidazoline softening agent was next added to the machine chest. The oleyl imidazoline was first diluted to a 1% solution prior to addition to the machine chest. The stock was further diluted to approximately 0.1 percent consistency prior to forming.

A cationic retention aid, Reten 1232 from Hercules, Inc., was made down to a 0.5% aqueous solution and added on the outlet side of the fan pump just prior to the headbox. The retention aid was added at a rate of 0.75 lbs. per metric ton of fiber plus filler. The formed web was non-compressively dewatered and rush transferred to a transfer fabric traveling at a speed about 25 percent slower than the forming fabric. The web was then transferred to a throughdrying fabric, dried and calendered. The total basis weight of the resulting sheet was about 14 pounds per 2880 $ft^2$. Total filler content (including titanium dioxide and kaolin) of the tissue as determined from ashing was 4.0%.

The use of imidazoline as the softener and both titanium dioxide and Kaolin as the particulate fillers in this Example resulted in a sheet with the worst panel grittiness top, panel stiffness, and panel softness proxy ratings when compared to the other four Examples described herein. The addition of Kaolin, another particulate filler besides the titanium dioxide, and the use of the imidazoline softener caused a significant increase in grittiness and stiffness and showed a decrease in overall sheet softness.

Example 5

A single-ply, non-layered uncreped throughdried tissue basesheet was made as described in Example 1, except the fibers were initially dispersed in a pulper for 5 minutes at a consistency of 3 percent. The temperature of the water in the pulper was raised to 120° F. (49 C.) prior to addition of the pulp. Two hundred and ten grams of a 15 percent aqueous solution (31 grams dry basis, 1.5 pounds per metric ton of dry fiber) of a commercially available alkylamide (REACTOPAQUE® 115 manufactured by Sequa Chemical Company) was added to the pulper and the pulp was allowed to disperse for 25 additional minutes. After pulping, the thick stock slurry was passed to a machine chest and diluted to a consistency of 1 percent. To the machine chest was added 2.5 pounds of rutile titanium dioxide and 2.5 pounds of a spray dried, predispersed kaolin, WW Fil SD manufactured by Dry Branch Kaolin. Forty-eight grams of a commercially available cationic starch, Redibond 5330 manufactured by National Starch was added next to the machine chest. The dry weight of starch used was equivalent to 2.0% of the total weight of dry filler. The starch was added as a 5% aqueous solution to the machine chest and was added after addition of the filler was completed.

After addition of the starch, 182 grams (8.8 pounds per metric ton of dry fiber) of a commercially available temporary wet strength resin, Parez 631-NC, was added to the machine chest. The dry strength resin was added as a 6 percent aqueous solution. Twenty grams (1 pound per metric ton of dry fiber) of a commercially available quaternary ammonium oleyl imidazoline softening agent was next added to the machine chest. The oleyl imidazoline was first diluted to a 1% solution prior to addition to the machine chest. The stock was further diluted to approximately 0.1 percent consistency prior to forming. The stock was further diluted to approximately 0.1 percent consistency prior to forming. A cationic retention aid, Reten 1232 from Hercules, Inc., was made down to a 0.5% aqueous solution and added on the outlet side of the fan pump just prior to the headbox. The retention aid was added at a rate of 0.75 lbs. per metric ton of fiber plus filler. The formed web was non-compressively dewatered and rush transferred to a transfer fabric traveling at a speed about 25 percent slower than the forming fabric. The web was then transferred to a throughdrying fabric, dried and calendered. The total basis weight of the resulting sheet was about 14 pounds per 2880 $ft^2$. Total filler content of the tissue as determined from ashing was 4.6%.

The product of this Example was tested, and it exhibited the lowest top and bottom panel grittiness of any of the Examples herein. Further, the product exhibited the lowest cross-machine direction stiffness factor, a high level of dry burst energy, and a high value of panel softness. All of these increased softness parameters were paralleled by an increase in opacity. Thus, even in the presence of two particulate fillers, (titanium dioxide and Kaolin), the alkylamide softening agent was able to increase the softness of the product while not sacrificing strength and opacity.

TABLE I

| Example No. | BD Basis Weight/ 2880 ft$^2$ | Fiber Basis Weight/ 2880 ft$^2$ | % Kaolin Filler | % $TiO_2$ Filler | Amount of R-115 #/ton | GMT | Panel Grittiness Top | Panel Grittiness Bottom | Panel Stiffness | PSP (Panel Softness Proxy) |
|---|---|---|---|---|---|---|---|---|---|---|
| 1 | 13.71 | 13.7 | 0 | 0 | 0 | 478 | 4 | 4 | 5 | 5 |
| 2 | 13.36 | 13.1 | 0 | 2.2 | 0 | 547 | 2 | 1 | 2 | 2 |
| 3 | 13.87 | 13.6 | 0 | 2.3 | 3 | 549 | 3 | 3 | 4 | 3 |
| 4 | 13.73 | 13.2 | 2 | 2 | 0 | 645 | 1 | 2 | 1 | 1 |
| 5 | 14.09 | 13.4 | 2.3 | 2.3 | 3 | 513 | 5 | 5 | 3 | 4 |

TABLE I-A

| Example No. | Panel Fuzzy Top | Panel Fuzzy Bottom |
|---|---|---|
| 1 | 3 | 3 |
| 2 | 1 | 2 |
| 3 | 4 | 5 |
| 4 | 2 | 1 |
| 5 | 5 | 4 |

TABLE II

| Example No. | Softener Type | Amount of Softener #/Metric Ton | Caliper | CD Tensile | CD Max Slope | CD Stiffness Factor | Dry Burst Energy | ISO Opacity |
|---|---|---|---|---|---|---|---|---|
| 1 | Imidazoline | 3.0 | 0.0098 | 350 | 11.05 | 34.6 | 219 | 53.8 |
| 2 | Imidazoline | 2.0 | 0.0098 | 391 | 14.65 | 45.9 | 211 | 56.67 |
| 3 | Alkylamide | 3.0 | 0.0108 | 381 | 8.82 | 29.0 | 329 | 57.32 |
| 4 | Imidazoline | 1.0 | 0.0106 | 475 | 17.35 | 56.5 | 250 | 58.32 |
| 5 | Alkylamide | 1.5 | 0.0104 | 357 | 9.11 | 29.4 | 296 | 60.42 |
| | Imidazoline | 1.0 | | | | | | |

The results of the preceding examples clearly show the advantages of using the alkylamide over the quaternary imidazoline-based materials alone. For example, the CD stiffness factor increased from 34.6 to 45.9 to 56.5 with the addition of 2.2% and 4% filler respectively when the oleyl imidazoline was used. However, when the alkylamide was used, the CD stiffness factors (29.0 and 29.4) were lower than even the control without filler. Another surprising result is the increase in dry burst energy seen in samples containing filler and alkylamide. Although dry burst energy is expected to vary directly with GMT, a plot of GMT vs. dry burst energy clearly shows the superiority of using the alkylamide softening agent over a conventional quaternary ammonium softening agent such as an oleyl imidazoline.

The following Examples 6–9 represent other aspects of the present invention as compared to the employment of the opacity-enhancing materials in wet pressed processes.

Example 6

A two-ply, wet-pressed bath tissue having a basis weight of 19 pounds per 2880 ft.$^2$ was made in a conventional manner. More specifically, 60 pounds (oven dry basis) of eucalyptus hardwood kraft fiber and 40 pounds (oven dry basis) of northern softwood kraft fiber were dispersed in a pulper for 30 minutes at a consistency of 3 percent. The thick stock slurry was then passed to a machine chest and diluted to a consistency of 1 percent. To the machine chest was added 10.3 grams (0.5 pounds per metric ton of dry fiber) of a commercially available wet strength resin, Parez 631-NC, and 41.3 grams (2 pounds per metric ton of dry fiber) of a commercially available dry strength resin, Redibond 2005, and 49.6 grams (2.4 pounds per metric ton of dry fiber) of a commercially available imidazoline softening agent (C-6027 from Witco Corporation). The stock was further diluted to about 0.1% consistency prior to forming, dewatering, drying and creping of the tissue web, which was plied together with a like web and calendered to form the final two-ply tissue product.

Example 7

A sheet was made as in Example 6, except that 163.2 grams dry basis (8 pounds per metric ton of dry fiber) of a commercially available alkylamide softening agent, Reactopaque 102, was added to the pulper.

Example 8

A one-ply, non-layered, uncreped throughdried tissue basesheet was made generally in accordance with U.S. Pat. No. 5,607,551 as previously described. More specifically, 50 pounds (oven dry basis) of eucalyptus hardwood kraft fiber and 50 pounds (oven dry basis) of northern softwood kraft fiber were dispersed in a pulper for 30 minutes at a consistency of 3 percent. The thick stock slurry was then passed to a machine chest and diluted to a consistency of 1 percent. The stock was further diluted to approximately 0.1 percent consistency prior to forming. The formed web was non-compressively dewatered and rush transferred to a transfer fabric traveling at a speed about 25 percent slower than the forming fabric. The web was then transferred to a through-drying fabric and dried. The total basis weight of the resulting sheet was 16 pounds per 2880 ft$^2$.

Example 9

A single-ply, non-layered uncreped through dried tissue basesheet was made as described in Example 8 with the exception that 165.2 grams dry basis (8 pounds per metric ton of dry fiber) of a commercially available softening agent, Reactopaque 102, was added to the pulper. The tissue products of Examples 6–9 were tested for GMT strength and the results are set forth in Table III. As above, the add-on level (expressed as "Level" in the Table) of the softening agent is expressed as pounds per metric ton of fiber on a dry basis.

TABLE III

| Example | Method | Alkylamide Softening Agent | Level | GMT | Strength Loss |
|---|---|---|---|---|---|
| 6 | Wet-press | None | 0 | 1391 | — |
| 7 | Wet-press | Yes | 8 | 613 | 55.9 |
| 8 | Throughdried | None | 0 | 950 | — |
| 9 | Throughdried | yes | 8 | 840 | 11.6 |

The results shown in Table III illustrate that in a conventional wet-pressing process the use of alkylamide softening agents causes significant debonding and weakening of the sheet with a 55.9 percent loss in tensile strength. However, in a process not involving compressive dewatering, the use of alkylamide softening agents in accordance with this invention demonstrate significantly less debonding and weakening of the sheet. In the example above only a 11.6 percent tensile loss was observed for the same level of addition.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the preferred versions contained therein.

What is claimed is:

1. A non-compressively formed paper product comprising a particulate filler and an amount of one or more alkylamide and/or alkylimide softening agents having at least one of the following structures:

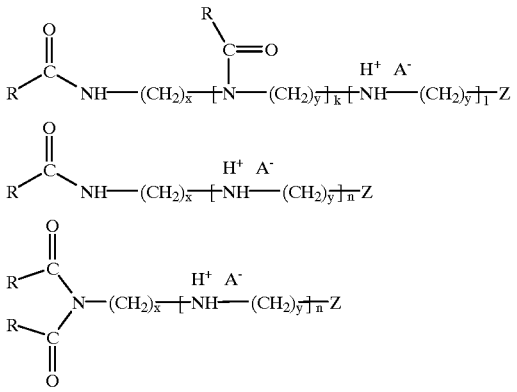

wherein:

R=any saturated or unsaturated fatty acid group having a chain length of 6 to 22 carbon atoms;

n=0–6;

x=1 to 6;

y=1 to 6;

k, l≧0, k+l=n

Z=H, OH; and

A=any anion of a strong or weak acid.

2. A paper product according to claim 1 wherein said product is softer than a similar product not comprising said softening agents.

3. A paper product according to claim 1 wherein said amount of said softening agent, on a solids basis, is from about 0.5 to about 20 pounds per metric ton of dry fiber.

4. A paper product according to claim 1 wherein said amount of said softening agent, on a solids basis, is from about 2 to about 20 pounds per metric ton of dry fiber.

5. A paper product according to claim 1 wherein said amount of said softening agent, on a solids basis, is from 3 to about 10 pounds per metric ton of dry fiber.

6. A paper product according to claim 1 wherein Z=OH.

7. A paper product according to claim 1 wherein said particulate filler is a filler selected from the group consisting of kaolin clay, calcium carbonate, and titanium dioxide.

8. A paper product according to claim 1 wherein said particulate filler is a filler selected from the group consisting of talc, zirconium dioxide, zinc oxide, calcium silicate, aluminum silicate, calcium sulfate, alumina trihydrate, and mixtures of such materials.

9. A paper product according to claim 1 further comprising a wet strength agent.

10. A paper product according to claim 1 further comprising a dry strength agent.

11. A paper product according to claim 1 further comprising a quaternary ammonium oleyl imidazoline softening agent.

12. A paper product according to claim 1 further comprising a quaternary ammonium softening agent.

13. A paper product according to claim 1 wherein said softening agent has the following structure:

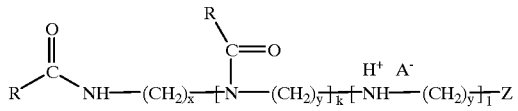

wherein:

R=any saturated or unsaturated fatty acid group having a chain length of 6 to 22 carbon atoms;

x=1 to 6;

y=1 to 6;

k, l≧0, k+l=0–6

Z=H, OH; and

A=any anion of a strong or weak acid.

14. A paper product according to claim 1 wherein said softening agent has the following structure:

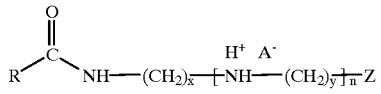

wherein:

R=any saturated or unsaturated fatty acid group having a chain length of 6 to 22 carbon atoms;

n=0–6;

x=1 to 6;

y=1 to 6;

k, l≧0, k+l=n

Z=H, OH; and

A=any anion of a strong or weak acid.

15. A paper product according to claim 1 further comprising an alkylamide softening agent having the following structure:

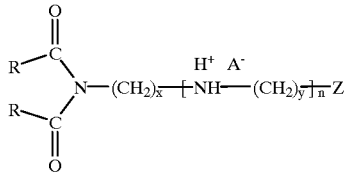

wherein:

R=any saturated or unsaturated fatty acid group having a chain length of 6 to 22 carbon atoms;

n=0–6;

x=1 to 6;

y=1 to 6;

Z=H, OH; and

A=any anion of a strong or weak acid.

16. A paper product according to claim 1, wherein said particulate filler is present in an amount of from about 1% to about 30% by weight based on the total weight of said paper product.

17. A paper product according to claim 1, wherein said particulate filler is present in an amount of from about 2% to about 20% by weight based on the total weight of said paper product.

18. A paper product according to claim 1, wherein said particulate filler is present in an amount of from about 3% to about 10% by weight based on the total weight of said paper product.

19. A method of making a soft and strong paper product comprising:

(a) adding an amount of one or more softening agents to an aqueous suspension of papermaking fibers containing a particulate filler, said softening agent having one or more of the following structures:

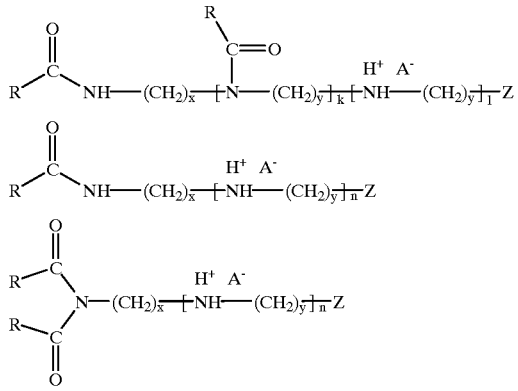

wherein:

R=any saturated or unsaturated fatty acid group having a chain length of 6 to 22 carbon atoms;

n=0–6;

x=1 to 6;

y=1 to 6;

k, l≧0, k+l=n

Z=H, OH; and

A=any anion of a strong or weak acid, (b) depositing the aqueous suspension of papermaking fibers onto a forming fabric to form a paper web; and (c) non-compressively drying the web to form a soft paper sheet.

20. A method of making a soft and strong paper product according to claim 19 wherein said non-compressively drying is performed according to an uncompressed through-air drying process.

21. A method of making a soft and strong paper product according to claim 19 wherein said particulate filler is a filler selected from the group consisting of kaolin clay, calcium carbonate, titanium dioxide, talc, zirconium dioxide, zinc oxide, calcium silicate, aluminum silicate, calcium sulfate, alumina trihydrate, and mixtures of such materials.

* * * * *